US005778486A

United States Patent [19]

Kim

[11] Patent Number: 5,778,486

[45] Date of Patent: Jul. 14, 1998

[54] INDICATOR DEVICE FOR A VACUUM CLEANER DUST CONTAINER WHICH HAS AN ADDITIONAL PRESSURE CONTROLLER

[75] Inventor: Suk-Gu Kim, Seoul, Rep. of Korea

[73] Assignee: Daewoo Electronics Co., Ltd., Seoul, Rep. of Korea

[21] Appl. No.: 739,042

[22] Filed: Oct. 28, 1996

[30] Foreign Application Priority Data

Oct. 31, 1995 [KR] Rep. of Korea ..... 95-38636

[51] Int. Cl.[6] ..... A47L 5/00

[52] U.S. Cl. ..... 15/339; 116/272

[58] Field of Search ..... 15/339; 116/266, 116/268, 272, DIG. 25

*Primary Examiner*—Diana Biefeld

*Attorney, Agent, or Firm*—Beveridge, DeGrandi, Weilacher & Young LLP

[57] ABSTRACT

Disclosed is an indicator device for visually in detail denoting the amount of filled dust in a dust container of a vacuum cleaner with time. The indicator device operates based on a vacuum pressure difference created between an air suction port and an outlet of the vacuum cleaner. A first plunger and a second plunger slidablely positioned in a first cylinder primarily decrease the vacuum degree in a dust collecting compartment and continuously display the amount of filled dust in the dust container. For this purpose, the first plunger is colored red and the second plunger is colored green. A third plunger slidablely positioned in a second cylinder secondarily decreases the vacuum degree in a dust collecting compartment. The user of the vacuum cleaner can notice the operating state of the vacuum cleaner or the replacement time of the dust container by observing the first plunger and the second plunger through a transparent window installed at a hood of the vacuum cleaner.

22 Claims, 8 Drawing Sheets

INDICATOR DEVICE FOR A VACUUM CLEANER DUST CONTAINER WHICH HAS AN ADDITIONAL PRESSURE CONTROLLER

BACKGROUND OF THE INVENTION

1. Field of the Invention

The present invention relates to an indicator device for a vacuum cleaner dust container, and more particularly to an indicator device for a vacuum cleaner dust container capable of visually denoting in detail an amount of dust or other foreign substances filled in the vacuum cleaner dust container as time passes by and capable of effectively preventing the over-loading of a motor of the vacuum cleaner.

2. Description of the Prior Art

Generally, a vacuum cleaner is provided with a disposable dust container for receiving a certain amount of dust collected by the vacuum cleaner. The dust container storing dust sucked into the vacuum cleaner should be replaced by a new dust container when the dust container is filled with dust. If the dust container filled with dust is not replaced by a new dust container in a timely manner, the function of the vacuum cleaner will deteriorate. That is, when an excessive amount of dust is collected in the dust container, the flow of the sucked air into the vacuum cleaner will meet a quite strong resistance. This may result in an over-loading of the driving motor of the vacuum cleaner and further, may destroy the driving motor. For preventing the above-mentioned results, an indicator device for a vacuum cleaner for notifying the user of the replacement time of the dust container has been developed.

Until now, various kinds of indicator devices for a vacuum cleaner have been suggested. Generally, the indicator devices let the user of the vacuum cleaner always notice the filling amount of dust in the dust container and replace the filled dust container with a new dust container when the dust container is completely filled.

FIG. 5A illustrates a canister-type vacuum cleaner 100. Vacuum cleaner 100 includes a floor cleaning unit 110 to which a brush is installed, a canister unit 120 and a hose assembly 130 extending between floor cleaning unit 110 and canister unit 120. Hose assembly 130 comprises a rigid wand and a flexible hose, and is pneumatically connected to a dust collecting compartment 140 (see FIG. 5B) of canister unit 120 through a suction hose connector 132.

Canister unit 120 mainly includes a hood 122, a cover 124 and a body 126. Hood 122 encloses dust collecting compartment 140 and is pivotally installed onto body 126 so as to open and close dust collecting compartment 140. Accordingly, hood 122 can be selectively positioned either in a closed position as illustrated in FIG. 5A or in an open position as illustrated in FIG. 5B. Hood 122 is also provided with an inlet opening 127 formed through hood 122 for receiving hose assembly 130. Hood 122 also is provided with a transparent window 128 for notifying the user of the dust collecting state. Cover 124 encloses a motor compartment (not shown) where an electric motor and a suction fan driven by the electric motor are positioned.

FIG. 5B schematically illustrates an internal structure of canister unit 120. In body 126 of canister unit 120, dust collecting compartment 140 is formed. In dust collecting compartment 140, a dust container 50 is accommodated. Dust container 50 includes a flat collar 52 made of strawboard and a receptacle portion 56 made of porous paper. Collar 52 is combined with receptacle portion 56 by glue. In the central portion of collar 52, an aperture 58 is formed.

Aperture 58 is arranged so as to communicate with an air suction port 59 formed at the central portion of a dust container mounting portion 54. Dust container 50 is mounted on dust container mounting portion 54 by means of collar 52.

Meanwhile, on the upper portion of dust collecting compartment 140, an indicator device 10 for notifying the user of the operation state of vacuum cleaner 100 and the replacement time of dust container 50, is installed. Indicator device 10 is pneumatically connected with dust collecting compartment 140 through a nipple 40 extending between one end of indicator device 10 and dust collecting compartment 140. Indicator device 10 operates based on the pressure difference created between air suction port 59 and an outlet (not shown) formed in body 126 of canister unit 120.

FIGS. 6A, 6B & 7 illustrate in detail the internal structure of the conventional indicator device 10.

Indicator device 10 includes a transparent cylinder 12. At the open end of cylinder 12, an adjusting cap assembly 20 is inserted. Adjusting cap assembly 20 plays the role of adjusting the operating time of indicator device 10 by controlling the flow area of air. Adjusting cap assembly 20 includes a circular end cap 22 and a hollow fixing member 24. End cap 22 and fixing member 24 are tightly engaged to each other. At end cap 22, a semicircular first opening 26 is formed. First opening 26 is a passageway for air at an atmosphere to flow in.

The other end of cylinder 12 is fixed by insertion into a nipple 40 installed at the upper portion of dust collecting compartment 140 (see FIG. 5B). Indicator device 10 communicates with dust collecting compartment 140 through nipple 40. Nipple 40 plays the role of an air transporting tube.

A cylindrical and hollow first plunger 30 and a cup-shaped second plunger 32 are slidablely and vertically positioned within cylinder 12. First plunger 30 and second plunger 32 are tightly engaged to each other in cylinder 12. First plunger 30 is provided with a plurality of second openings 31 formed at a side portion thereof and a third opening 33 formed at an open end thereof. Second openings 31 and third opening 33 become passageways for air at an atmosphere to flow in. The closed end of first plunger 30 is inserted into the other end opposite to the end of fixing member 24 into which end cap 22 is inserted.

Second plunger 32 is provided with a fourth opening 35 formed through the center thereof. Fourth opening 35 becomes a passageway for air at an atmosphere to flow in. At the outer periphery of second plunger 32, a plurality of recesses 34 are formed. O-shaped sealing rings 36 are disposed in recesses 34.

In second plunger 32, a cylindrical protrusion 37 for fixing a compression spring 38 is formed. Compression spring 38 is positioned between second plunger 32 and nipple 40. One end of compression spring 38 is fixed to protrusion 37 of second plunger 32, and the other end of compression spring 38 is fixed to one end of nipple 40. Compression spring 38 elastically supports first plunger 30 and second plunger 32. That is, first plunger 30 and second plunger 32 are elastically supported by compression spring 38, and are pushed toward the end of cylinder 12 where adjusting cap assembly 20 is positioned.

Meanwhile, first plunger 30 and second plunger 32 were colored by two colors, respectively, for notifying the user of vacuum cleaner 100 of the normal operation state and the completion state of the dust collection of vacuum cleaner 100. Preferably, first plunger 30 is colored red and second plunger 32 is colored green. By observing by naked eyes first plunger 30 and second plunger 32 through transparent window 128 installed at a hood 122 (see FIGS. 6A & 7), the user of the vacuum cleaner can notice the operating state of indicator device 10. Meanwhile, transparent window 128 can be substituted by a through groove 129 as illustrated in FIG. 6B, in order to reduce the manufacturing cost.

The operating process of the conventional indicator device 10 having the abovedescribed structure will be briefly described below.

First, referring to FIGS. 5A & 5B, when a suction fan (not shown) positioned under cover 124 of canister unit 120 is driven by a motor (not shown), suction is achieved toward dust collecting compartment 140. As a result, air containing dust is sucked into dust collecting compartment 140 of canister unit 120 through floor cleaning unit 110 and hose assembly 130. Then, receptacle portion 56 of dust container 50 positioned in dust container 50 starts to expand. Since receptacle portion 56 of dust collecting compartment 140 is made of porous paper as described above, air containing dust that is sucked into dust container 50 is filtered while passing through receptacle portion 56, and the filtered air is exhausted out through an outlet (not shown) formed in body 126 of canister unit 120 and the motor. At this time, the granular dust cannot pass through receptacle portion 56, so is caught in dust container 50.

Meanwhile, when vacuum cleaner 100 operates normally as described above, indicator device 10 operates based on the pressure difference created between air suction port 59 and the outlet, and notifies the user of vacuum cleaner 100 of a normal operating state.

That is, if dust or other foreign substances do not completely fill receptacle portion 56 of dust container 50, the vacuum pressure created between dust container 50 and the motor in dust collecting compartment 140 is not high enough to overcome the predetermined elastic force of compression spring 38 in indicator device 10. As illustrated in FIGS. 6A & 6B, therefore, a special pressure difference is not created in cylinder 12. As a result, since first plunger 30 colored red is not separated from fixing member 24, second plunger 32 colored green is exposed to the outside of vacuum cleaner 100 through transparent window 128 or through groove 129. The user observes the color by his naked eyes and notices that vacuum cleaner 100 is in a normal operating state.

On the contrary, when dust or other foreign substances completely fill receptacle portion 56 of dust container 50, the flow of air sucked into dust collecting compartment 140 of canister unit 120 from floor cleaning unit 110 of vacuum cleaner 100 through hose assembly 130, meets resistance. That is, when dust or other foreign substances completely fill receptacle portion 56 of dust container 50, air cannot easily pass through receptacle portion 56.

As a result, the vacuum degree created between receptacle portion 56 of dust container 50 positioned in dust collecting compartment 140 and the motor positioned in a motor compartment (not shown) is heightened. That is, a relatively high vacuum pressure is created in dust collecting compartment 140 when compared to that of vacuum cleaner 100 in a normal state.

Therefore, a relatively high vacuum pressure is created at the open end of nipple 40 in cylinder 12, which is pneumatically connected to dust collecting compartment 140 through nipple 40. As a result, air at an atmosphere acts on the outer surface of first plunger 30 through first opening 26 and hollow fixing member 24 in cylinder 12, overcomes the predetermined elastic force of compression spring 38, and pushes first plunger 30 toward the open end of nipple 40. Thus, first plunger 30 is pushed away from fixing member 24. At the same time, air is introduced through the separated space between fixing member 24 and first plunger, and pushes second plunger 32 exposed to the separated space. As a result, air at an atmosphere flows in second opening 31, third opening 33, fourth opening 35 and nipple 40 into dust collecting compartment 140.

Meanwhile, when integrally formed first plunger 30 and second plunger 32 move toward the open end of nipple 40, second plunger 32 colored green passes by transparent window 128 or through groove 129 provided at hood 122 of vacuum cleaner 100, so first plunger 30 colored red is exposed to the outside of vacuum cleaner 100 through transparent window 128 or through groove 129. The user of vacuum cleaner 100 observes by his naked eyes first plunger 30 through transparent window 128 or through groove 129 and can notice that it is time to replace dust container 50, which is filled with dust or other foreign substances, with a new dust container.

However, in the conventional indicator device 10 as described above, it is impossible to denote in detaile the amount of filled dust or other foreign substances in dust container 50 of vacuum cleaner 100 as time passes by. Accordingly, the user of the vacuum cleaner 100 cannot notice the operating state of vacuum cleaner 100 and the most suitable replacement time of dust container 50.

In addition, in the conventional indicator device 10 as described above, a suitable amount of air at an atmosphere cannot be sucked into dust collecting compartment 140 in accordance with the amount of filled dust or other foreign substances in dust container 50. Therefore, it is impossible to effectively prevent an over-loading of the motor of vacuum cleaner 100 with effect. Also, the suction force created by the motor is decreased.

Further, for the safe operation of visible indicator device 10, the pressure difference created between air suction port 59 and the outlet of dust collecting compartment 140 should be accurately maintained. Moreover, when through groove 129 is formed at hood 122 instead of transparent window 128 in order to reduce the manufacturing cost, impurities infiltrate into dust collecting compartment 140.

U.S. Pat. No. 4,060,050 issued to Sven Bertil Simonsson on Nov. 29, 1977, discloses a fill indicator of a vacuum cleaner developed to reduce the manufacturing cost thereof and increase the accuracy of the operation thereof. Sven Bertil Simonsson's fill indicator includes a transparent cylinder and a chamber separated by a diaphragm. At one side of the cylinder, a spigot tube connected with an air suction port of a dust container, to which atmospheric pressure is applied, is installed. At one side wall of the chamber, a nipple connected with an outlet of the dust container, is installed. In the cylinder, a hollow piston and a journal longitudinally disposed through a side wall of the cylinder, are positioned. The piston is rotatably connected to the journal. In the chamber, a compression spring for elastically supporting the diaphragm is installed.

Sven Bertil Simonsson's fill indicator as briefly described above, notifies the user of the replacement time of the dust container by linear reciprocation of the diaphragm and by rotational movement of the piston based on the pressure difference created between the inlet and the outlet of the dust container.

However, Sven Bertil Simonsson's fill indicator could not completely solve the problems of the conventional indicator device 10. Sven Bertil Simonsson's fill indicator does not have a special constitution for visually denoting in detail the amount of filled dust in the dust container of the vacuum cleaner as time passes by. Moreover, Sven Bertil Simonsson's fill indicator has a relatively more complicated internal constitution than that of the conventional indicator device 10. Therefore, minute machine processing is needed and the manufacturing cost thereof is high.

SUMMARY OF THE INVENTION

The present invention is contrived to solve the foregoing problems. It is an object of the present invention to provide an indicator device for a vacuum cleaner dust container capable of visually denoting in detail an amount of dust or other foreign substances filled in the vacuum cleaner dust container as time passes by and capable of effectively preventing the over-loading of a motor of the vacuum cleaner.

In order to achieve the above object, the present invention provides an indicator device for visually indetail denoting an amount of filled dust in a dust container of a vacuum cleaner, the indicator comprising:

a transparent first cylinder including a first adjusting cap assembly installed to one end thereof for adjusting the operating time of the indicator device by controlling the flowing area of air at an atmosphere, including an indicating means, and including a first supporting means for elastically supporting the indicating means, in which the indicating means primarily decreases the vacuum degree in a dust collecting compartment and continuously displays the amount of filled dust in the dust container;

a second cylinder including a second adjusting cap assembly installed to one end thereof for adjusting the operating time of the indicator device by controlling the flowing area of air at an atmosphere, including a pressure control means for secondarily decreasing the vacuum degree in the dust collecting compartment, and including a second supporting means for elastically supporting the pressure control means, and a connecting tube allowing for fluid-communication of the first cylinder with the second cylinder, and for pneumatically connecting the first cylinder and the second cylinder to the dust collecting compartment.

The first adjusting cap assembly includes a first end cap having a first opening formed through the first end cap and includes a hollow first fixing member.

The indicating means is slidablely positioned within the first cylinder and includes a first plunger and a second plunger, the first plunger comprises a plurality of second openings formed at the side surface of the first plunger and a third opening formed at the center of an open end of the first plunger, and the second plunger comprises a fourth opening formed through a center of the second plunger and a first cylindrical protrusion for fixing the first supporting means. Preferably, the first plunger is colored red and the second plunger is colored green. The second plunger further comprises a recess formed at a side surface of the second plunger and comprises an O-shaped sealing ring disposed in the recess.

The first supporting means is a compression spring and is disposed between the first cylindrical protrusion and a first end of the connecting tube.

The second adjusting cap assembly includes a second end cap having a fifth opening formed through the second end cap and includes a hollow second fixing member. A diameter of the fifth opening is greater than a diameter of the first opening.

The pressure control means is a third plunger which is slidablely positioned within the second cylinder and which includes a second cylindrical protrusion for fixing the second supporting means.

The second supporting means is a compression spring and is disposed between the second cylindrical protrusion and a second end of the connecting tube.

The connecting tube includes a horizontal first communicating tube and a vertical second communicating tube. A diameter of the second communicating tube is greater than the sum of the diameter of the first opening and a diameter of the fifth opening. The second communicating tube includes a taper formed in a position adjacent to the first communicating tube, and in which a diameter of the taper is the same as the diameter of the first communicating tube.

As described above, in the indicator device according to the present invention, the third plunger is additionally installed within the indicator device. The third plunger secondarily controls the pressure difference created in the indicator device, and supplements the function of the first plunger and the second plunger. As a result, the indicator device according to the present invention can denote visually in detail the amount of filled dust in the dust container of the vacuum cleaner as time passes by. Thereby, the user of the vacuum cleaner can notice the operating state of the vacuum cleaner and the most suitable replacement time of the dust container.

Also, the indicator device according to the present invention intakes a suitable amount of air at an atmosphere in accordance with the filling degree of dust or other foreign substances in the dust container. As a result, an over-loading of the motor of vacuum cleaner is effectively prevented.

BRIEF DESCRIPTION OF THE DRAWINGS

The above object and other characteristics and advantages of the present invention will become more apparent by describing in detail a preferred embodiment thereof with reference to the attached drawings, in which.

DETAILED DESCRIPTION OF THE INVENTION

Figure 1:
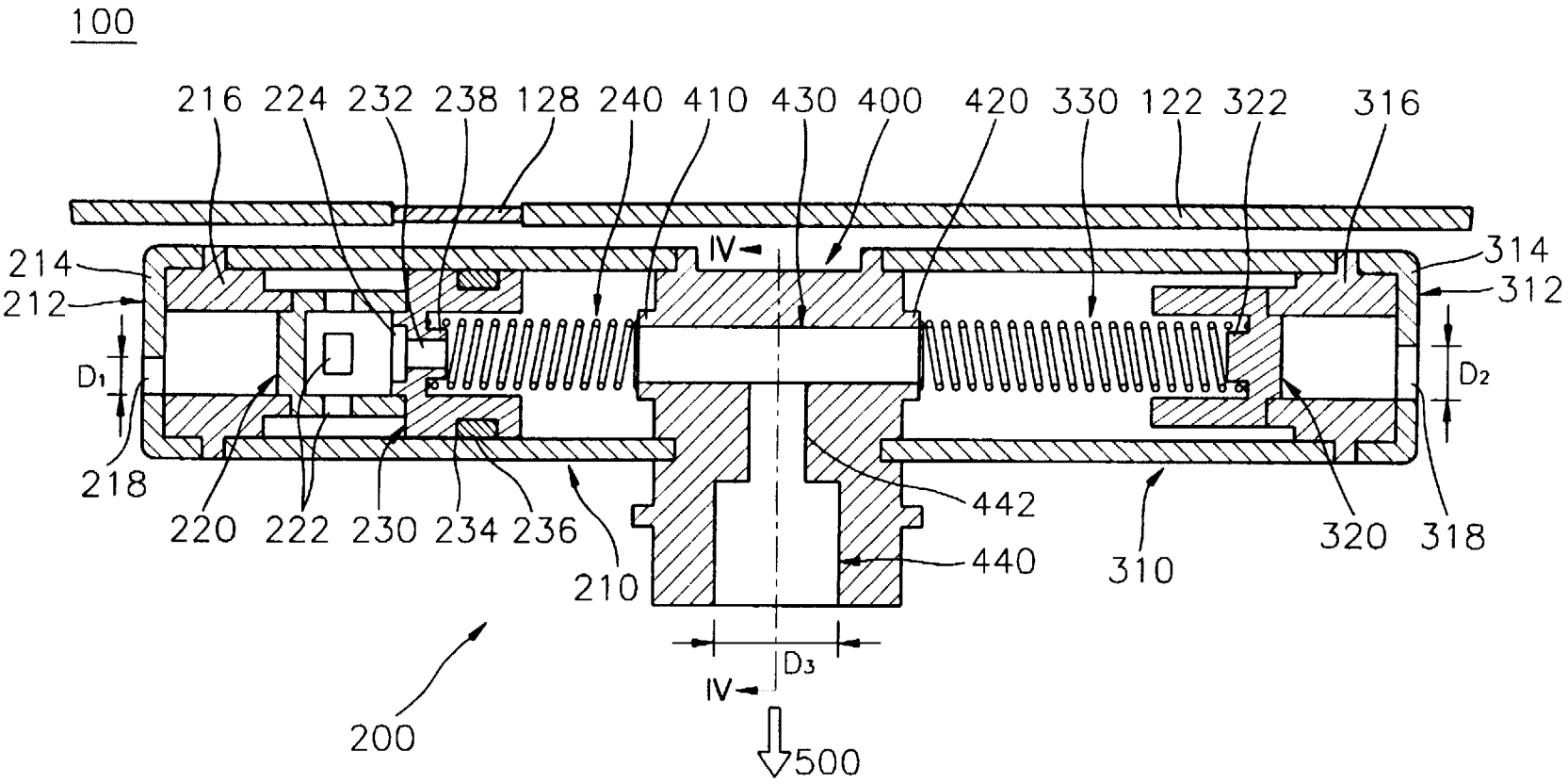
FIG. 1 is a longitudinal cross-sectional view of an indicator device for a vacuum cleaner dust container according to a preferred embodiment of the present invention.

Hereinafter, the preferred embodiment of the present invention will be explained in more detail with reference to the accompanying drawings.

FIGS. 1 to 4 illustrate an indicator device 200 according to a preferred embodiment of the present invention. First, referring to FIG. 1, indicator device 200 includes a transparent first cylinder 210, a second cylinder 310 and a T-shaped nipple 400.

At an open end of first cylinder 210, a first adjusting cap assembly 212 is inserted. First adjusting cap assembly 212 plays the role of adjusting the operating time of indicator device 200 by controlling the flow area of air. First adjusting cap assembly 212 includes a first circular end cap 214 and a hollow first fixing member 216. First end cap 214 and first fixing member 216 are tightly fitted to each other. At first end cap 214, a first opening 218 having a predetermined diameter $D_1$, is formed. First opening 218 is a passageway for air at an atmosphere to flow in.

A cylindrical first plunger 220 and a cup-shaped second plunger 230 are slidablely and vertically positioned within first cylinder 210. First plunger 220 and second plunger 230 are tightly fitted to each other in first cylinder 210. First plunger 220 is provided with a plurality of second openings 222 formed at a side portion thereof and a third opening 224 formed at an open end thereof. Second openings 222 and third opening 224 become passageways for air at an atmosphere to flow in. The closed end of first plunger 220 is inserted into the other end opposite to the end of first fixing member 216 into which first end cap 214 is inserted.

Second plunger 230 is provided with a fourth opening 232 formed through the center thereof. Fourth opening 232 becomes a passageway for air at an atmosphere to flow in. At the outer periphery of second plunger 230, a plurality of recesses 234 are formed. O-shaped sealing rings 236 are disposed in recesses 234. In second plunger 230, a cylindrical first protrusion 238 for fixing a first compression spring 240 is formed.

First compression spring 240 is positioned between second plunger 230 and nipple 400. One end of first compression spring 240 is fixed to a first cylindrical protrusion 238 of second plunger 230, and the other end of first compression spring 240 is fixed to a first end 410 of nipple 400. Thus installed first compression spring 240 elastically supports first plunger 220 and second plunger 230. That is, first plunger 220 and second plunger 230 are elastically supported by first compression spring 240, and are pushed toward the end of first cylinder 210 where first adjusting cap assembly 212 is positioned.

Figure 5A:
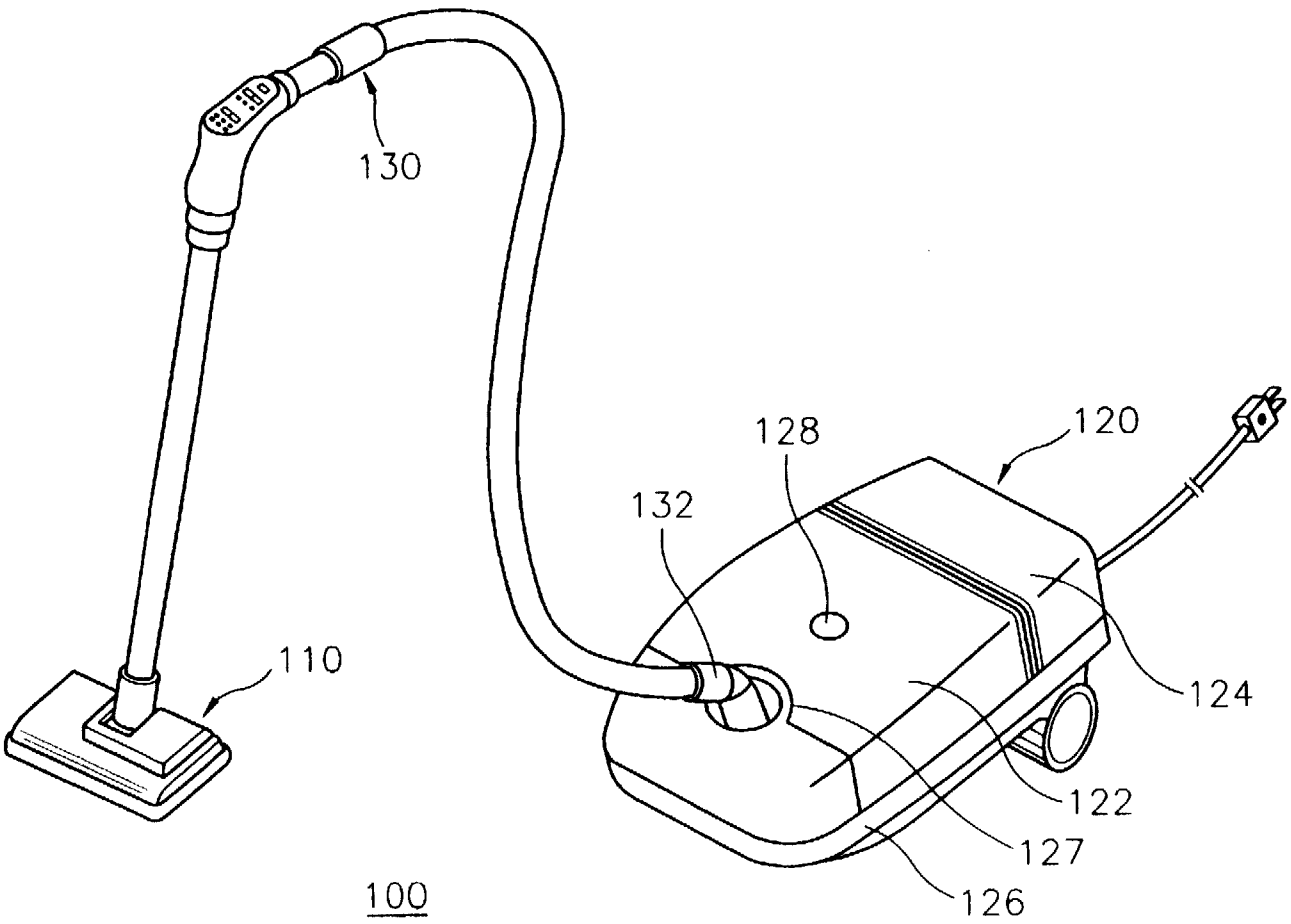
FIG. 5A (PRIOR ART)
FIG. 5A is a perspective view of a conventional canister-type vacuum cleaner.
Figure 5B:
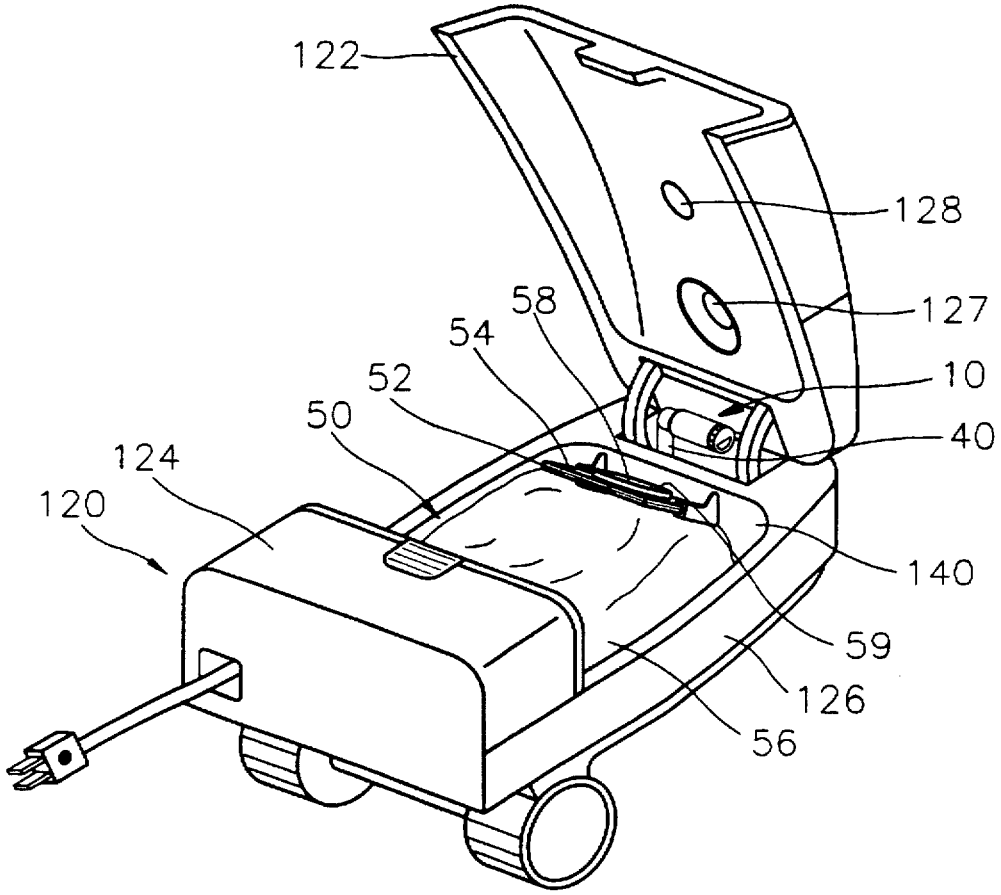
FIG. 5B (PRIOR ART)
FIG. 5B is a perspective view of a canister unit with its hood opened for showing the installed position of the indicator device installed in the canister unit of the vacuum cleaner illustrated in FIG. 5A.
Figure 6A:
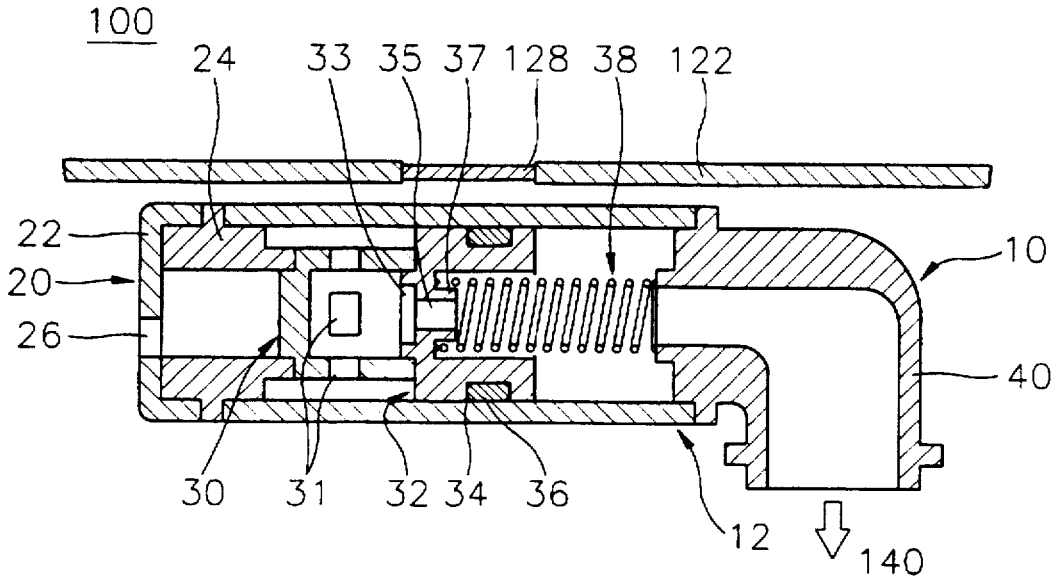
FIG. 6A (PRIOR ART)
FIG. 6A is a longitudinal cross-sectional view of the conventional indicator device installed in a vacuum cleaner having a transparent window on a hood.
Figure 6B:
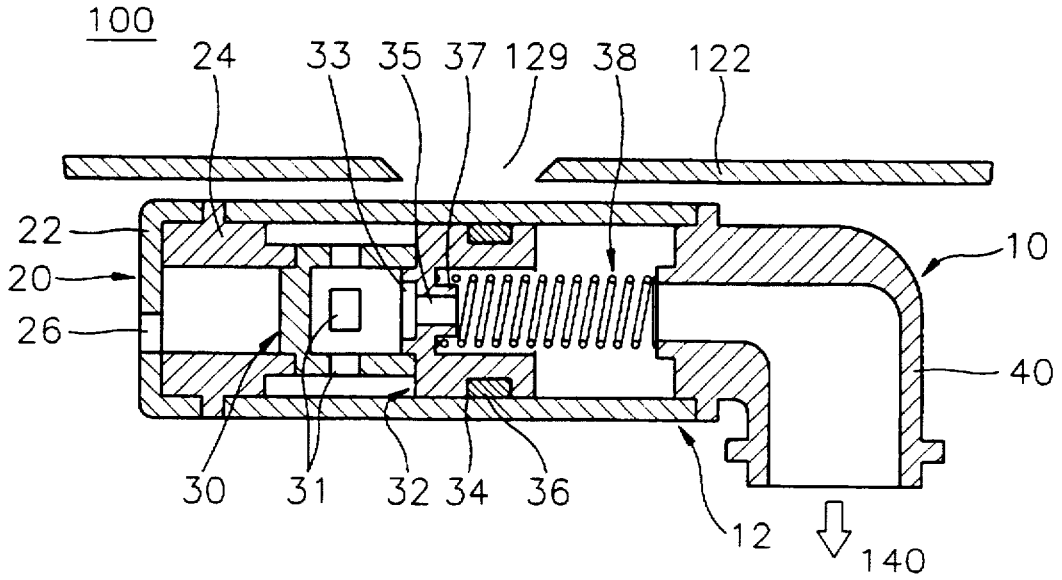
FIG. 6B (PRIOR ART)
FIG. 6B is a longitudinal cross-sectional view of the conventional indicator device installed in a vacuum cleaner having a through groove on a hood.
Figure 7:
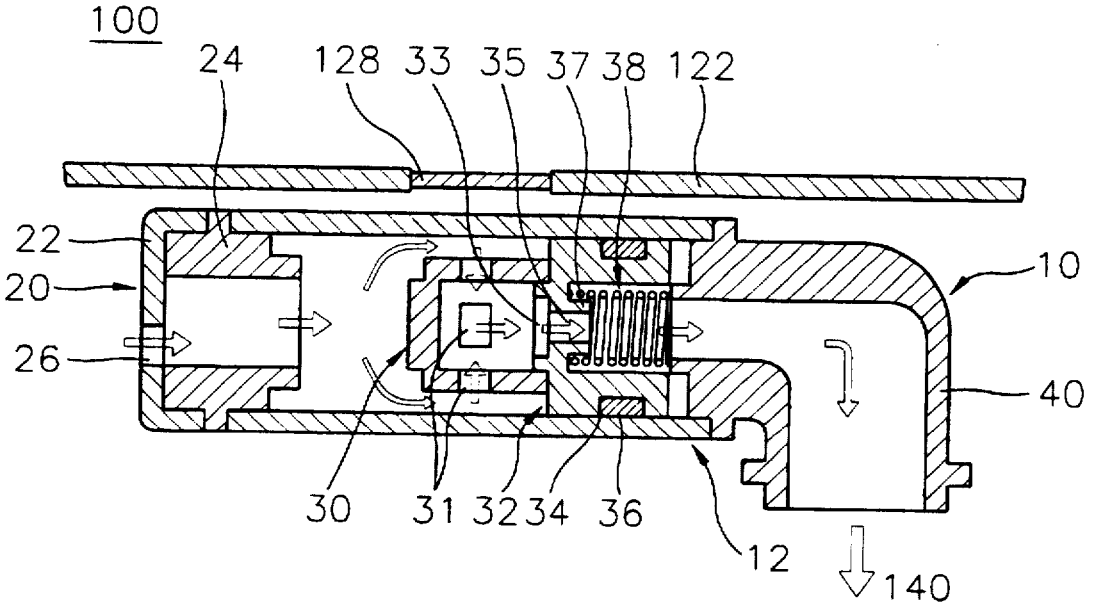
FIG. 7 (PRIOR ART)
FIG. 7 is a longitudinal cross-sectional view for showing the operating state of the indicator device illustrated in FIG. 6A.

First plunger 220 and second plunger 230 were colored by two colors, respectively, for notifying the user of vacuum cleaner 100 of the normal operation state and the completion state of the dust collection of vacuum cleaner 100. Preferably, first plunger 220 is colored red and second plunger 230 is colored green. By observing by naked eyes first plunger 220 and second plunger 230 through transparent window 128 installed at a hood 122, the user of the vacuum cleaner can notice the operating state of indicator device 200 and the replacement time of dust container 50 (see FIG. 5B) filled with dust or other foreign substances.

Meanwhile, at an open end of second cylinder 310, a second adjusting cap assembly 312 is inserted. Second adjusting cap assembly 312 plays the role of adjusting the operating time of indicator device 200 by controlling the flow area of air. Second adjusting cap assembly 312 includes a second circular end cap 314 and a hollow second fixing member 316. Second end cap 314 and second fixing member 316 are tightly fitted to each other. At second end cap 314, a fifth opening 318 is formed. The diameter $D_2$ of fifth opening 318 is greater than the diameter $D_1$, of first opening 218. Fifth opening 318 is a passageway for air at an atmosphere to flow in.

A cup-shaped third plunger 320 is slidablely and vertically positioned within second cylinder 310. One end of third plunger 320 is inserted into second fixing member 316. At the inner portion of third plunger 320, a second cylindrical protrusion 322 for fixing a second compression spring 330 is formed.

The elastic modulus of second compression spring 330 is greater than the elastic modulus of first compression spring 240 disposed in first cylinder 210. Second compression spring 330 is positioned between third plunger 320 and nipple 400. One end of second compression spring 330 is fixed to second cylindrical protrusion 322 of third plunger 320, and the other end of second compression spring 330 is fixed to a second end 420 of nipple 400. Thus installed second compression spring 330 elastically supports third plunger 320. That is, third plunger 320 is elastically supported by second compression spring 330, and is pushed toward the end of second cylinder 310 where second adjusting cap assembly 312 is positioned.

Meanwhile, T-shaped nipple 400 is installed at the upper portion of a dust collecting compartment 500. T-shaped nipple 400 allows for fluid communication of indicator device 200 with dust collecting compartment 500. That is, T-shaped nipple 400 plays the role of a transporting tube for air. Nipple 400 includes a horizontal first communicating tube 430 and a vertical second communicating tube 440. First communicating tube 430 pneumatically connects first cylinder 210 with second cylinder 310. As illustrated in detail in FIG. 4, second communicating tube 440 is connected to the middle of first communicating tube 430. Second communicating tube 440 extends between first communicating tube 430 and dust collecting compartment 500. Second communicating tube 440 has a taper portion 442 in a position adjacent to first communicating tube 430 for easily connecting with first communicating tube 430. Preferably, the diameter of taper portion 442 is the same as the diameter of first communicating tube 430. Second communicating tube 440 has a predetermined diameter $D_3$. The diameter $D_3$ is greater than the sum of the diameter $D_1$ of first opening 218 formed through first end cap 214 and the diameter $D_2$ of fifth opening 318 formed through second end cap 314.

Indicator device 200 according to the present invention having the constitution as described above, is mounted into vacuum cleaner 100 in a manner such that the user of vacuum cleaner 100 can notice by naked eyes first plunger 220 or second plunger 230, which are disposed in first cylinder 210, through transparent window 128. Therefore, the user of vacuum cleaner 100 can notice the operating state of vacuum cleaner 100 and the replacement time of the dust container positioned in dust collecting compartment 500 by observing the interior of first cylinder 210 of indicator device 200 through transparent window 128.

The operating process of indicator device 200 according to a preferred embodiment of the present invention will be described below.

Indicator device 200 according to the present invention operates based on a pressure difference created between air suction port 59 (see FIG. 5B) and the outlet (not shown), and notifies the user of vacuum cleaner 100 of the normal operating state.

Referring to FIG. 1, if dust or other foreign substances does not completely fill dust container positioned in dust collecting compartment 500 so that the cleaning-capability of vacuum cleaner 100 is not deteriorated, a predetermined vacuum pressure created between the dust container and the motor in the motor compartment (not shown) is not high enough to overcome the predetermined elastic force of first compression spring 240 and second compression spring 330 in indicator device 200. In other words, if we call the vacuum pressure capable of overcoming the predetermined elastic force of first compression spring 240 as $P_1$, and we call the vacuum pressure capable of overcoming the predetermined elastic force of second compression spring 330 as $P_2$, a predetermined vacuum pressure $P_a$ smaller than $P_1$ is created between the dust container and the motor.

Then, the vacuum pressure $P_a$ is also created in first cylinder 210 and second cylinder 310 which are pneumatically connected with dust collecting compartment 500 through first communicating tube 430 and second communicating tube 440 of nipple 400. That is, the vacuum pressure $P_a$ is created at first end 410 of nipple 400 in first cylinder 210 and is created at second end 420 of nipple 400 in second cylinder 310.

When the vacuum pressure $P_a$, which is smaller than the vacuum pressure $P_1$, is created at first end 410 and second end 420, no special pressure difference is created in first cylinder 210 and second cylinder 310.

As a result, first plunger 220 and second plunger 230, which are elastically supported by first compression spring 240 in first cylinder 210, are not separated from the inner surface of first fixing member 216. That is, since the vacuum pressure $P_a$, which is smaller than the vacuum pressure $P_1$ is created at first end 410 of nipple 400, first compression spring 240 elastically supports first plunger 220 and second plunger 230 without withdrawing from its initial position. Accordingly, air at an atmosphere introduced into first cylinder 210 through first opening 218 and through the hollow first fixing member 216 cannot push away first plunger 220 and second plunger 230 from the inner surface of first fixing member 216.

Further, third plunger 320 elastically supported by second compression spring 330 in second cylinder 310 is not separated from second fixing member 316. That is, since the vacuum pressure $P_a$ smaller than the vacuum pressure $P_1$, is created at second end 420 of nipple 400, second compression spring 330 elastically supports third plunger 320 without withdrawing from its initial position. Accordingly, air at an atmosphere introduced into second cylinder 310 through fifth opening 318 and through hollow second fixing member 316 cannot push away third plunger 320 from the inner surface of second fixing member 316.

In this case, second plunger 230 in first cylinder 210 is exposed to the outside of vacuum cleaner 100 through transparent window 128 installed at hood 122 of vacuum cleaner 100. Therefore, the user of vacuum cleaner 100 observes by his naked eyes second plunger 230 colored green and notices the normal operating state of vacuum cleanser 100.

In contrast, when dust or other foreign substances fill the dust container positioned in dust collecting compartment 500 so that the cleaning-capability of vacuum cleaner 100 is deteriorated, the flow of air sucked into dust collecting compartment 500 meets resistance. That is, when dust or other foreign substances fill the dust container positioned in dust collecting compartment 500 so that the cleaning-capability of vacuum cleaner 100 is deteriorated, air cannot easily pass through the dust container.

As a result, the vacuum degree created between the dust container positioned in dust collecting compartment 500 and the motor positioned in a motor compartment is heightened. That is, a relatively higher vacuum pressure is created in dust collecting compartment 500 when compared to that of vacuum cleaner 100 in a normal state.

Figure 2:
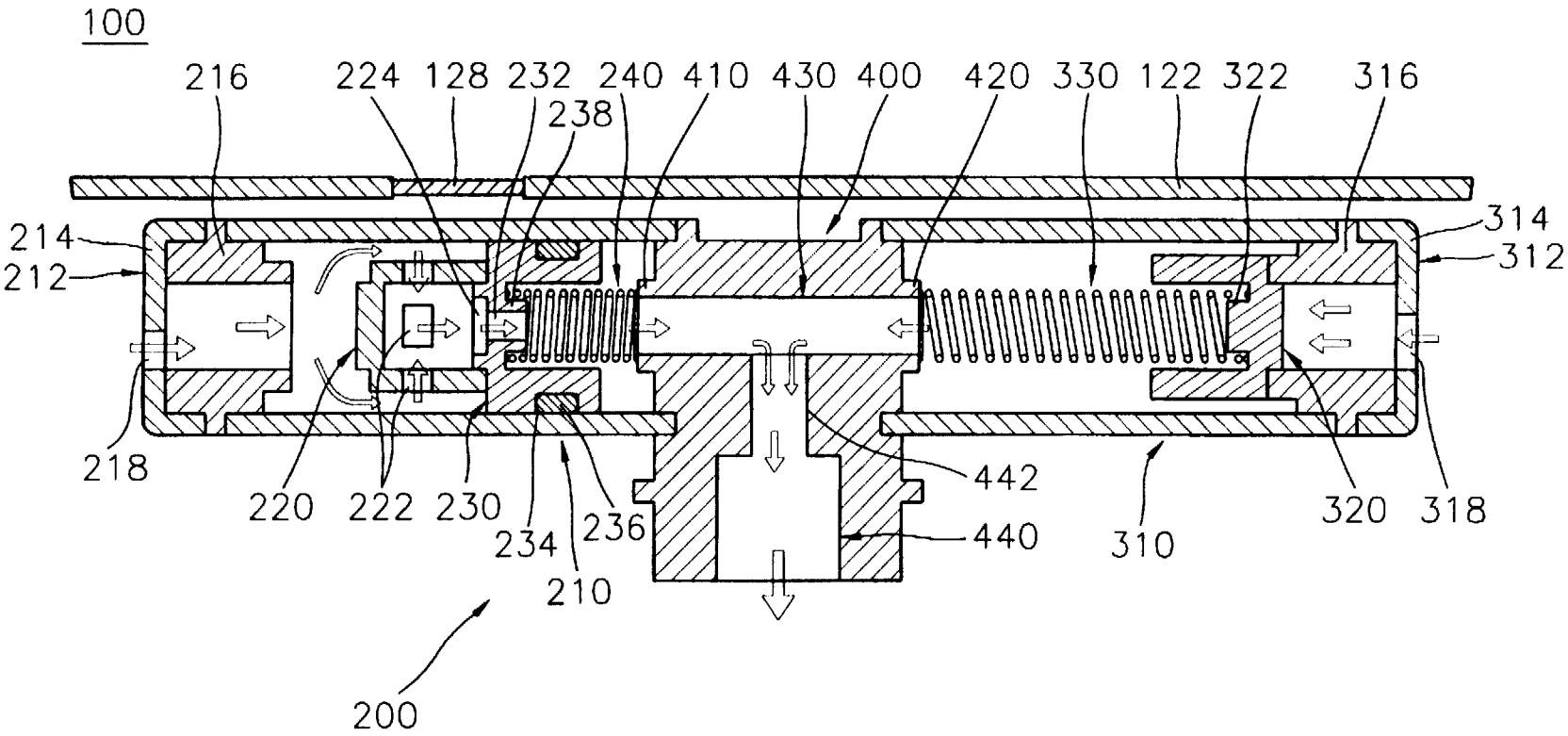
FIG. 2 is a longitudinal cross-sectional view of the indicator device for showing an operating state of the indicator device when the dust container of the vacuum cleaner is filled with a certain amount of dust or other foreign substances.

Referring to FIG. 2, if a predetermined vacuum pressure $P_b$ which is greater than the vacuum pressure $P_1$, and is smaller than the vacuum pressure $P_2$ and so is large enough to overcome the predetermined elastic force of first compression spring 240, is created in dust collecting compartment 500, the predetermined vacuum pressure $P_b$ is also created in first cylinder 210 and second cylinder 310 which are pneumatically connected with dust collecting compartment 500 through first communicating tube 430 and second communicating tube 440 of nipple 400. That is, the vacuum pressure $P_b$ is created at first end 410 of nipple 400 in first cylinder 210 and is created at second end 420 of nipple 400 in second cylinder 310.

When the vacuum pressure $P_b$, which is greater than the vacuum pressure $P_1$ and is smaller than the vacuum pressure $P_2$, is created at first end 410 of nipple 400, air at an atmosphere acting on the outer surface of first plunger 220 through first opening 218 and through hollow first fixing member 216 in first cylinder 210 overcomes the predetermined elastic force of first compression spring 240 and pushes first plunger 220 toward first end 410 of nipple 400. Accordingly, first plunger 220 is pushed away from first fixing member 216. Then, first plunger 220 is separated from first fixing member 216 and air introduced through the separated space pushes second plunger 230, which is exposed to the separated space toward first end 410 of nipple 400.

As a result, air at an atmosphere passes through second opening 222, third opening 224 and fourth opening 232, and is directed into dust collecting compartment 500 through first communicating tube 430 and second communicating tube 440. As a result, the vacuum degree in dust collecting compartment 500 is lowered and accordingly, an overloading of the motor can be prevented. If an equilibrium of pressure is established in first cylinder 210 by introducing air at an atmosphere into dust collecting compartment 500, then first plunger 220 and second plunger 230 do not move toward first end 410 of nipple 400.

However, when the vacuum pressure $p_b$, which is greater than the vacuum pressure $P_1$ and is smaller than the vacuum pressure $P_2$, is created at second end 420 of nipple 400, third plunger 320 elastically supported by second compression spring 330 in second cylinder 310 does not separate from the inner surface of second fixing member 316. That is, since the vacuum pressure $P_b$, which is smaller than the vacuum pressure $P_2$ is created at second end 420 of nipple 400, air at an atmosphere introduced into second cylinder 310 through fifth opening 318 formed at second end cap 314 and through hollow second fixing member 316 cannot separate third plunger 320 from the inner surface of second fixing member 316. Accordingly, air at an atmosphere introduced into second cylinder 310 cannot flow toward second end 420 of nipple 400.

Meanwhile, when first plunger 220 and second plunger 230 in first cylinder 210 move toward first end 410 of nipple 400 by the flow of air at an atmosphere as described above, a part of first plunger 220 colored red and a part of second plunger 230 colored green are exposed to the outside of the vacuum cleaner 100 through transparent window 128 installed at hood 122 of vacuum cleaner 100. Therefore, the user of vacuum cleaner 100 observes by his naked eyes first plunger 220 and second plunger 230 through transparent window 128 and notices the filling degree of dust container 50 filled with a certain amount of dust or other foreign substances.

If the user continuously uses vacuum cleaner 100 and thereby, the amount of dust or other foreign substances caught in the dust container is increased and a predetermined vacuum pressure $P_c$ greater than the vacuum pressure $P_2$ is created in dust collecting compartment 500, then the vacuum pressure $P_c$ is created in first cylinder 210 and second cylinder 310 which are pneumatically connected with dust collecting compartment 500 through first communicating tube 430 and second communicating tube 440. That is, the vacuum pressure $P_c$ is created at first end 410 of nipple 400 in first cylinder 210 and is created at second end 420 of nipple 400 in second cylinder 310.

Figure 3:
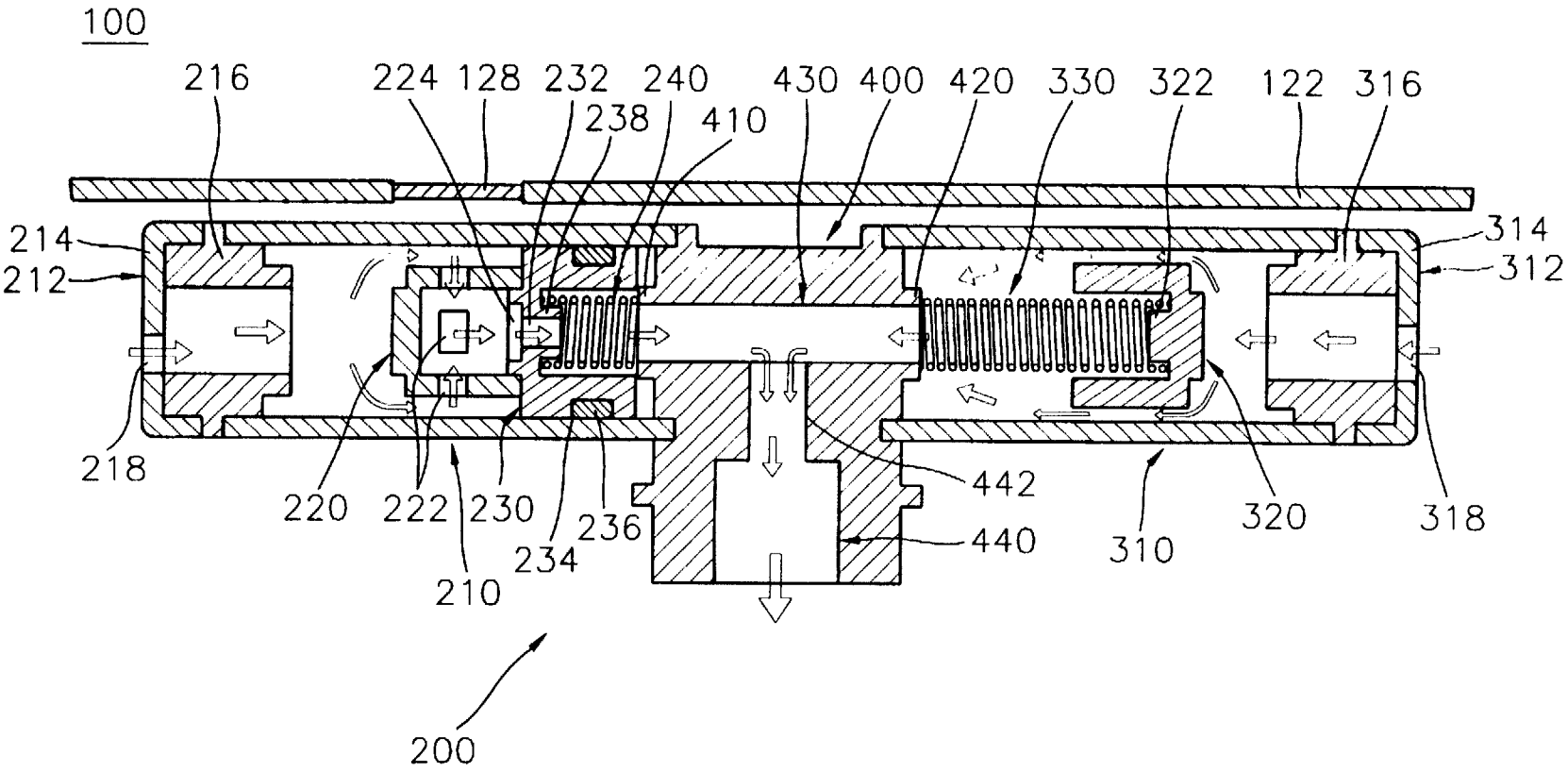
FIG. 3 is a longitudinal cross-sectional view of the indicator device for showing the operating state of the indicator device when the dust container of the vacuum cleaner is fully filled with dust or other foreign substances.
Figure 4:
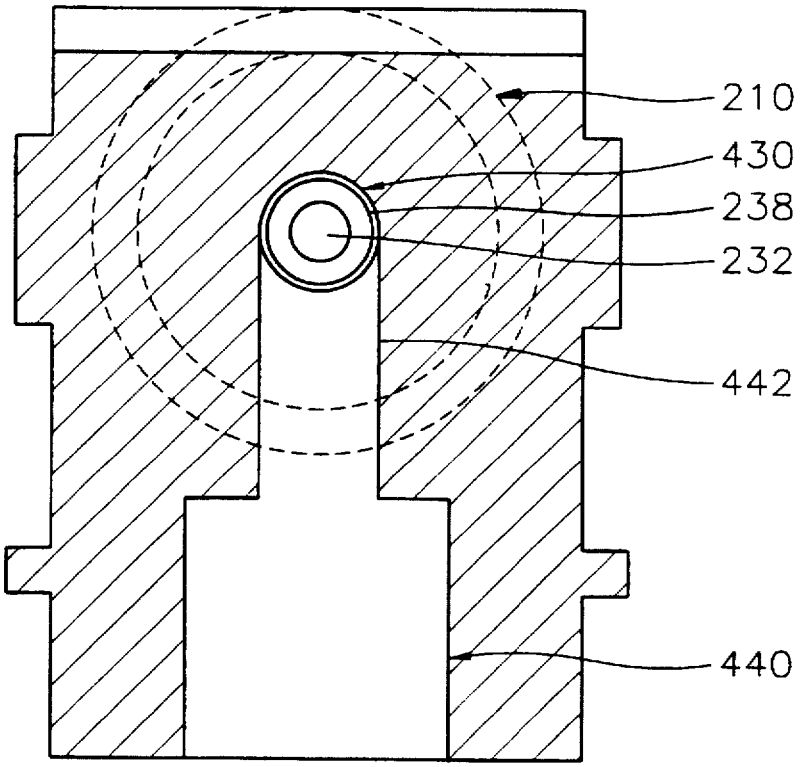
FIG. 4 is a cross-sectional view taken along line IV—IV of FIG. 1.

Referring to FIG. 3, if the vacuum pressure $P_c$ which is greater than the vacuum pressure $P_2$, is created in first cylinder 210 and so is large enough to overcome the predetermined elastic force of second compression spring 330, air at an atmosphere acting on the outer surface of first plunger 220 and the outer surface of second plunger 230 pushes first plunger 220 and second plunger 230 toward first end 410 of nipple 400 until first compression spring 240 is completely withdrawn from its initial position. At the same time, air at an atmosphere passes through second opening 222, third opening 224 and fourth opening 232, and is directed into dust collecting compartment 500 through first communicating tube 430 and second communicating tube 440. As a result, the vacuum degree in dust collecting compartment 500 is primarily lowered and accordingly, an overloading of the motor can be primarily prevented.

Further, when the vacuum pressure $P_c$, which is greater than the vacuum pressure $P_2$, is created at second end 420 of nipple 400 in second cylinder 310, air at an atmosphere acting on the outer surface of third plunger 320 overcomes the predetermined elastic force of second compression spring 330 and pushes third plunger 320 toward second end 420 of nipple 400. Then, third plunger 320 is separated from second fixing member 316 and at the same time, air introduced into the separated space pushes third plunger 320, which is exposed to the separated space, through the separated space. As a result, air at an atmosphere is directed into dust collecting compartment 500 through first communicating tube 430 and second communicating tube 440. As a result, the vacuum degree in dust collecting compartment 500 is secondarily lowered and accordingly, an over-loading of the motor can be secondarily prevented.

If an equilibrium of pressure in second cylinder 310 is established by introducing air at an atmosphere into dust collecting compartment 500 through first communicating tube 430 and second communicating tube 440, third plunger 320 does not move toward second end 420 of nipple 400.

Meanwhile, when first plunger 220 and second plunger 230 in first cylinder 210 completely move toward first end 410 of nipple 400 by the flow of air at an atmosphere as described above, only first plunger 220 colored red is exposed to the outside of vacuum cleaner 100 through transparent window 128 installed at hood 122 of vacuum cleaner 100. That is, second plunger 230 colored green passes by transparent window 128, while first plunger 220 colored red is exposed to the outside of vacuum cleaner 100 through transparent window 128. The user of vacuum cleaner 100 observes by his naked eyes first plunger 220 through transparent window 128 and can notice the replacement time of dust container filled with dust or other foreign substances.

While first plunger 220 colored red is exposed to the outside of vacuum cleaner 100 through transparent window 128 installed to hood 122 of vacuum cleaner 100, if the user continuously uses vacuum cleaner 100 without changing the dust container completely filled with dust or other foreign substances, the amount of dust or other foreign substances caught in the dust container is increased and the dust container is oversaturated. Then, a predetermined vacuum pressure $P_d$ greater than the vacuum pressure $P_c$ is created in dust collecting compartment 500, and the vacuum pressure $P_d$ is also created in first cylinder 210 and second cylinder 310. That is, the vacuum pressure $P_d$ is created at first end 410 of nipple 400 in first cylinder 210 and is created at second end 420 of nipple 400 in second cylinder 310.

As described above, if the vacuum pressure $P_d$ which is greater than the vacuum pressure $P_c$, is created at first end 410 of nipple 400 in first cylinder 210, first compression spring 240 is completely withdrawn. Therefore, first plunger 220 and second plunger 230 are most adjacent to first end 410 of nipple 400. At this time, air at an atmosphere passes through second opening 222, third opening 224 and fourth opening 232, and is directed into dust collecting compartment 500 through first communicating tube 430 and second communicating tube 440. As a result, the vacuum degree in dust collecting compartment 500 is primarily lowered and accordingly, an over-loading of the motor can be primarily prevented.

Further, the vacuum pressure $P_d$, which is greater than the vacuum pressure $P_c$, is created at second end 420 of nipple 400 in second cylinder 310, air at an atmosphere acting on the outer surface of third plunger 320 through fifth opening 318 and through hollow second fixing member 316 pushes third plunger 320 toward second end 410 of nipple 400 until second compression spring 330 is completely withdrawn. Accordingly, third plunger 320 moves toward second end 420 of nipple 400 and is positioned adjacent to second end 420. As a result, air at an atmosphere is directed into dust collecting compartment 500 through first communicating tube 430 and second communicating tube 440. Thereby, the vacuum degree in dust collecting compartment 500 is secondarily lowered and accordingly, an over-loading of the motor can be secondarily prevented.

Therefore, if the user continuously uses vacuum cleaner 100 without changing the dust container completely filled with dust or other foreign substances, indicator device 200 according to the present invention is capable of preventing an over-loading of the motor until third plunger 320 in second cylinder 310 is positioned most adjacent to second end 420 of nipple 400.

As described above, in contrast to the conventional indicator device 10 indicator device 200 according to the present invention further comprises third plunger 320. By secondarily controlling the pressure difference in indicator device 200, third plunger 320 supplements the function of first plunger 220 and second plunger 230. As a result, indicator device 200 can denote visually in detaile the amount of filled dust in the dust container of vacuum cleaner 100. Thereby, the user of the vacuum cleaner 100 can notice the operating state of vacuum cleaner 100 and the most suitable replacement time of the dust container.

Also, indicator device 200 according to the present invention intakes a suitable amount of air at an atmosphere in accordance with the filling degree of dust or other foreign substances in the dust container. As a result, an over-loading of the motor of vacuum cleaner is effectively prevented. Also, when the user of vacuum cleaner 100 does not replace the dust container completely filled with dust or other foreign substances and uses vacuum cleaner 100 continuously, an over-loading of the motor of vacuum cleaner 100 is prevented.

While the present invention has been particularly shown and described with reference to a particular embodiment thereof, it will be understood by those skilled in the art that various changes in form and detail may be effected therein without departing from the spirit and scope of the invention as defined by the appended claims.

What is claimed is:

1. An indicator device for visually in detail denoting an amount of filled dust in a dust container of a vacuum cleaner comprising:

a transparent first cylinder including an indicating means for denoting the amount of the filled dust and a first adjusting cap assembly installed to one end thereof for adjusting an operating time of the indicating means by controlling a flowing area of a first air under an atmospheric pressure, and including a first supporting means for elastically supporting said indicating means, said indicating means being slidably positioned in said transparent first cylinder so as to primarily decrease a vacuum degree in a dust collecting compartment and continuously displays an amount of filled dust in the dust container;

a second cylinder including a second cap assembly installed to one end thereof for controlling a flowing area of a second air under an atmospheric pressure, including a pressure control means for secondarily decreasing the vacuum degree in the dust collecting compartment, and including a second supporting means for elastically supporting said pressure control means; and a connecting tube allowing for fluid-communication of said first cylinder, and for pneumatically connecting said first cylinder and said second cylinder to the dust collecting compartment.

2. An indicator device as claimed in claim 1, wherein said first adjusting cap assembly includes a first end cap having a first opening formed through said first end cap and includes a hollow first fixing member.

3. An indicator device as claimed in 2, wherein said second adjusting cap assembly includes a second end cap having a fifth opening formed through said second end cap and includes a hollow second fixing member.

4. An indicator device as claimed in claim 3, wherein a diameter of said fifth opening is greater than a diameter of said first opening.

5. An indicator device as claimed in claim 4, wherein a diameter of said second communicating tube is greater than a sum of the diameter of said first opening and a diameter of said fifth opening.

6. An indicator device as claimed in claim 1, wherein said indicating means is slidablely positioned within said first cylinder and includes a first plunger and a second plunger, said first plunger comprises a plurality of second openings formed at a side surface of said first plunger and a third opening formed at a center of an open end of said first plunger, and said second plunger comprises a fourth opening formed through a center of said second plunger and a first cylindrical protrusion for fixing said first supporting means.

7. An indicator device as claimed in claim 6, wherein said first plunger is colored red and said second plunger is colored green.

8. An indicator device as claimed in claims 6, wherein said second plunger has a recess formed at a side surface of said second plunger and comprises an O-shaped sealing ring disposed in said recess.

9. An indicator device as claimed in claim 6, wherein said first supporting means is a compression spring and is disposed between said first cylindrical protrusion and a first end of said connecting tube.

10. An indicator device as claimed in claim 1, wherein said pressure control means is a third plunger which is slidablely positioned within said second cylinder and which includes a second cylindrical protrusion for fixing said second supporting means.

11. An indicator device as claimed in claim 10, wherein said second supporting means is a compression spring and is disposed between said second cylindrical protrusion and a second end of said connecting tube.

12. An indicator device as claimed in claim 1, wherein said connecting tube includes a horizontal first communicating tube and a vertical second communicating tube.

13. An indicator device as claimed in claim 12, wherein said second communicating tube includes a taper formed in a position adjacent to said first communicating tube, and at the position a diameter of said taper is the same as the diameter of said first communicating tube.

14. An indicator device for visually in detail denoting an amount of filled dust in a dust container of a vacuum cleaner comprising:

(a) a transparent first cylinder including an indicating means for denoting the amount of the filled dust and a first adjusting cap assembly installed to one end thereof for adjusting an operating time of the indicating means by controlling a flowing area of a first air under an atmospheric pressure, and including a first supporting means for elastically supporting said indicating means, said indicating means being slidably positioned in said transparent first cylinder so as to primarily decrease a vacuum degree in a dust collecting compartment and continuously displays an amount of filled dust in the dust container, said first adjusting cap assembly includes a first end cap having a first opening formed through said first end cap and includes a hollow first fixing member, and includes a first plunger and a second plunger, said first plunger comprises a plurality of second openings formed at a side surface of said first plunger and a third opening formed at a center of an open end of said first plunger, and said second plunger comprises a fourth opening formed through a center of said second plunger and a first cylindrical protrusion for fixing said supporting means, said second plunger has a recess formed at a side surface of said second plunger and comprises an O-shaped sealing ring disposed in said recess;

(b) a second cylinder including a second cap assembly installed to one end thereof for controlling a flowing area of a second air under an atmospheric pressure, including a pressure control means for secondarily decreasing the vacuum degree in the dust collecting compartment, and including a second supporting means for elastically supporting said pressure control means, in which said second adjusting cap assembly includes a second end cap having a fifth opening formed through said second end cap and includes a hollow second fixing member, said pressure control means is a third plunger which is slidably positioned within said second cylinder and which includes a second cylindrical protrusion for fixing said second supporting means; and (c) a connecting tube allowing for air-communication of said first cylinder with second cylinder, and for pneumatically connecting said first cylinder and said second cylinder to the dust collecting compartment, in which said connecting tube includes a horizontal first communicating tube and a vertical second communicating tube, said second communicating tube includes a taper formed in a position adjacent to said first communicating tube, and at the position a diameter of said taper is the same as the diameter of said first communicating tube.

15. An indicator device as claimed in claim 14, wherein said first plunger is colored red and said second plunger is colored green.

16. An indicator device as claimed in claim 14, wherein said first supporting means is a compression spring and is disposed between said first cylindrical protrusion and a first end of said connecting tube.

17. An indicator device as claimed in claim 14, wherein a diameter of said fifth opening is greater than a diameter of said first opening.

18. An indicator device as claimed in claim 14, whereing said second supporting means is a compression spring and is disposed between said second cylindrical protrusion and a second end of said connecting tube.

19. An indicator device as claimed in claim 14, wherein a diameter of said second communicating tube is greater than a sum of a diameter of said first opening and a diameter of said fifth opening.

20. An indicator device for visually in detail denoting an amount of filled dust in a dust container of a vacuum cleaner comprising:

(a) a transparent first cylinder including an indicating means for denoting the amount of the filled dust and a first adjusting cap assembly installed to one end thereof for adjusting an operating time of the indicating means by controlling a flowing area of a first air under an atmospheric pressure, and including a first supporting means for elastically supporting said indicating means, said indicating means being slidably positioned in said transparent first cylinder so as to primarily decrease a vacuum degree in a dust collecting compartment and continuously displays an amount of filled dust in the dust container, and includes a first plunger and a second plunger, said first plunger comprises a plurality of second openings formed at a side surface of said first plunger and a third opening formed at a center of an open end if said first plunger, said first plinger is colored red, said second plunger comprises a gourth opening formed through a center of said second olunger and a first cylindrical protrusion for fixing said supporting means, said second plunger has a recess formed at a side surface of said second plunger and comprises an O-shaged sealing ring disposed in said recess, and said secind plunger is colored green;

(b) a second cylinder including a second cap assembly installed to one end thereof for controlling a flowing area of a second air under the atmospheric pressure, including a pressure control means for secondarily decreasing the vacuum degree in the dust collecting compartment, and including a second supporting means for elastically supporting said pressure supporting means, in which said adjusting cap assembly includes a second end cap having a fifth opening formed through said second end cap and includes a gollow second fixing member, said pressure control means is a third plunger which is slidably positioned within said second cylinder and which includes a second cylindrical protrusion for fixing said second supporting means, a diameter of said fifth poening is greater than a diameter of said first opening; and (c) a connecting tube allowing for fluid-communication of said first cylinder with said second cylinder, and for pneumatically connecting said first cylinder and said secind cylinder to the dust collecting compartment, in which said connecting tube includes a horizontal first communicating tube and a vertical second communicating tube, said second communicating tube includes a taper formed in a position adjacent to said first communicating tube, and a diameter of said taper is the same as the diameter of said first communicating tube, and at the position a diameter of said second communicating tube is greater than a sum of the diameter of said first opening and a diameter of said fifth opening.

21. An indicator device as claimed in claim 20, wherein said first supporting means is a compression spring and is disposed between said first cylindrical protrusion and a first end of said connecting tube.

22. An indicator device as claimed in claim 20, whereing said second supporting means is a compression spring and is disposed between said second cylindrical protrusion and a second end of said connecting tube.

* * * * *